United States Patent [19]

Berry et al.

[11] 4,375,352

[45] Mar. 1, 1983

[54] METHOD FOR MELTING A NON-FERROUS METAL CHARGE WITH LIQUID FUEL

[75] Inventors: Milton E. Berry; Ronald L. Pariani, both of Carrollton, Ga.

[73] Assignee: Southwire Company, Carrollton, Ga.

[21] Appl. No.: 921,039

[22] Filed: Jun. 30, 1978

[51] Int. Cl.[3] ..... F23C 5/00

[52] U.S. Cl. ..... 431/8; 431/12

[58] Field of Search ..... 431/8, 12, 189, 188, 431/186, 185, 284, 350, 182, 158, 174; 239/432; 48/197 FM, 180 A, 180 C, 180 D

[56] References Cited

U.S. PATENT DOCUMENTS

| | | | |
|---|---|---|---|
| 1,763,387 | 6/1930 | Beach | 431/189 X |
| 1,841,465 | 1/1932 | Branche | 431/188 |
| 3,485,566 | 12/1969 | Schoppe | 431/158 |
| 3,748,087 | 7/1973 | Shular | 431/185 X |
| 4,003,692 | 1/1977 | Moore | 431/284 X |
| 4,154,567 | 5/1979 | Dahmen | 431/284 X |
| 4,156,590 | 5/1979 | Pariani | 431/158 X |

FOREIGN PATENT DOCUMENTS

| | | | |
|---|---|---|---|
| 121243 | 7/1927 | Netherlands | 431/188 |
| 456011 | 7/1968 | Switzerland | 431/174 |
| 497112 | 12/1938 | United Kingdom | 431/12 |

*Primary Examiner*—Samuel Scott
*Assistant Examiner*—Randall L. Green
*Attorney, Agent, or Firm*—Herbert M. Hanegan; Stanley L. Tate; R. Steven Linne

[57] ABSTRACT

A method and burner apparatus for heating and continuously melting a non-ferrous material charge, such as copper pieces in a furnace without contaminating the material charge in the furnace with non-vaporized liquid fuel thereby maintaining the metallurgical quality of the non-ferrous material charge.

3 Claims, 5 Drawing Figures

METHOD FOR MELTING A NON-FERROUS METAL CHARGE WITH LIQUID FUEL

BACKGROUND OF THE INVENTION

The field of this invention relates to methods and apparatus for heating and melting a material charge in a furnace, particularly of the type used in heating and melting a non-ferrous material utilizing a liquid fuel.

In the prior art, there are many types of vertical furnace arrangements that have been used for melting various types of charge materials under a wide variety of different circumstances, such as the typical units disclosed in U.S. Pat. Nos. 2,203,163; 2,815,278; 2,886,304; 3,148,973; 3,199,977; 3,603,571; and 3,958,919. U.S. Pat. Nos. 3,715,203; 3,788,623; and, 3,809,378 generally disclose specific types of furnace arrangements that are particularly useful in melting non-ferrous metals.

However, within the prior art directed towards burners and their specific structural configurations, many varying types of burners have been designed to operate under a wide variety of particular applications and environments for use in heating a material charge having various individual characteristics. Such burners include those as disclosed in U.S. Pat. Nos. 2,605,180; 3,701,517; and 3,852,021. However, due to recent price increases and the widespread nonavailability of the cleaner gaseous fuels, it has become desirable to be able to burn various grades of fuel oils with such burners to provide the appropriate heating necessary for heating and melting a material charge within a furnace. Many attempts have been made at providing an effective, liquid fuel burner, such as those disclosed in U.S. Pat. Nos. 2,632,501; 2,697,910; 2,698,050; 2,711,214; and, 3,366,469. Further, other attempts in providing liquid fuel types of burners are disclosed in U.S. Pat. Nos. 2,205,983; 2,333,531; 2,632,300; 2,725,929; 3,042,105; 3,558,119; 3,749,548; 3,758,263; 3,777,983; 3,947,226; 3,980,415; 3,986,815; and 4,025,282.

However, despite the significant amount of art in the liquid fuel burner-furnace arrangements, so far as known, it has been a continuous problem that liquid fuel burners have not been able to effectively vaporize and substantially combust all of the liquid fuel prior to contacting the material charge within the furnace. When heating and melting non-ferrous materials, such as copper and aluminum, the vaporization and substantial combustion of the liquid fuel prior to contacting the material charge becomes of critical importance for maintaining control of the metallurgical quality of the melt; for, if droplets of liquid fuel actually contact the relatively cool surfaces of the material to be melted, the melt will preferentially remove oxygen from the gas stream leaving the liquid fuel uncombusted, resulting in a melted charge that is contaminated with the oxygen and some uncombusted liquid fuel. This contamination of the charge increases in severity as the grades of fuel oil being used to fire such a furnace are reduced. Therefore, it has been a significant problem in this art to utilize the more desirable, low cost, low grades of liquid fuels for heating non-ferrous materials without contaminating the melt with the liquid fuels that escape combusting prior to contacting the material charge to be melted.

SUMMARY OF THE INVENTION

The present invention relates to a new and improved method and burner apparatus for heating a non-ferrous material charge with a liquid fuel without contaminating the charge with the liquid fuel wherein the method includes the mixing and combining of liquid fuel, atomizing air, and combustion air prior to flowing the mixture into a combustion chamber formed in a refractory block wherein the mixture is turbulently mixed within the combustion chamber to insure vaporization of the mixture for substantially complete combustion of the mixture within the combustion chamber, and thereafter firing the vaporized mixture in the combustion chamber for providing the heat necessary for melting the non-ferrous material charge in the furnace while preventing contamination of the non-ferrous material charge with non-vaporized liquid fuel to maintain the metallurgical quality of the heated and melted non-ferrous material charge.

DESCRIPTION OF THE PREFERRED EMBODIMENT

Figure 1A:
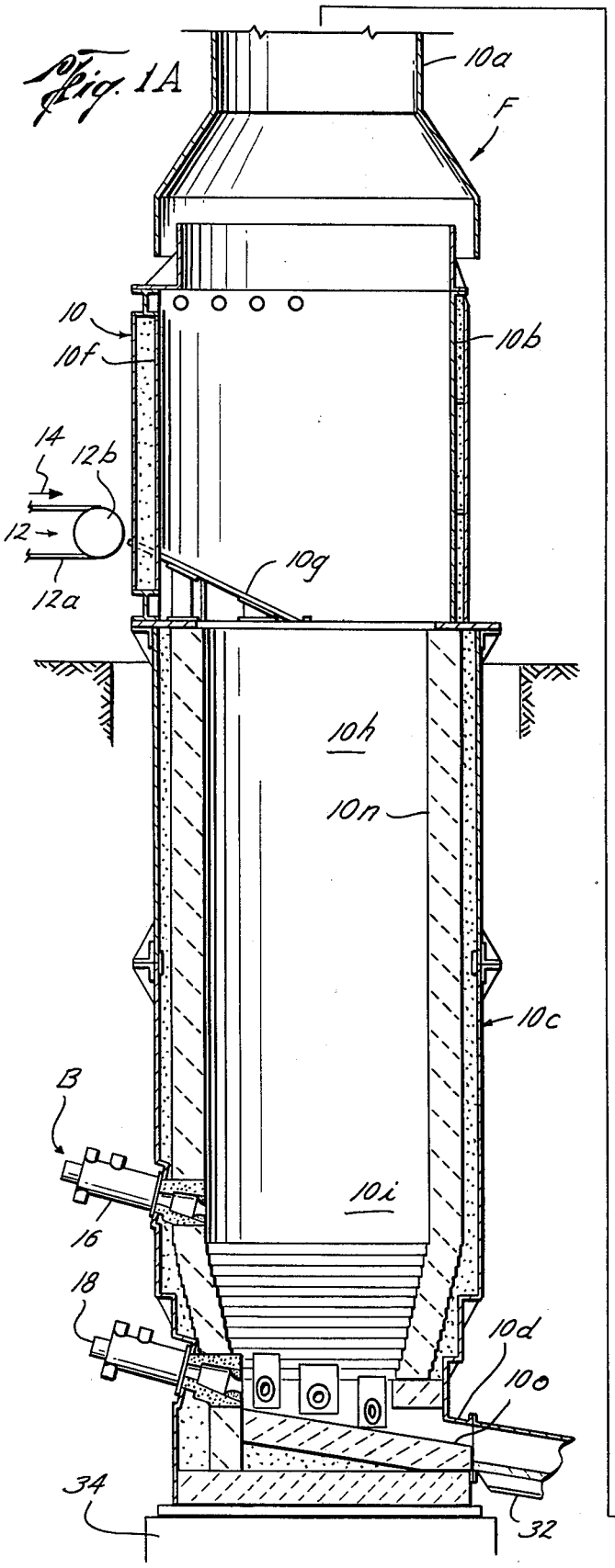
FIG. 1A shows an elevational, sectional view of the lower portion of a shaft-type furnace used for melting non-ferrous materials as used with the method and burner apparatus of the present invention.

In the drawings, the letter B refers generally to the burner apparatus of the present invention. The burner apparatus B is used for combusting liquid fuel for a furnace F for heating and melting a non-ferrous material charge, such as copper or aluminum, in the furnace F without contaminating the charge with the liquid fuel. The burner apparatus B of the present invention includes generally a refractory block R adapted to be mounted with the furnace F, valve means V mounted with the refractory block R, mixing throat means M formed between the refractory block R and the valve means V, a combustion chamber C formed within the refractory block R, with the combustion chamber C having turbulence means T formed therein. Unless otherwise specified, it is preferred that the components of the present invention are made of steel or other suitable high-strength materials capable of taking significant stresses and strains without failure thereof.

Figure 1B:
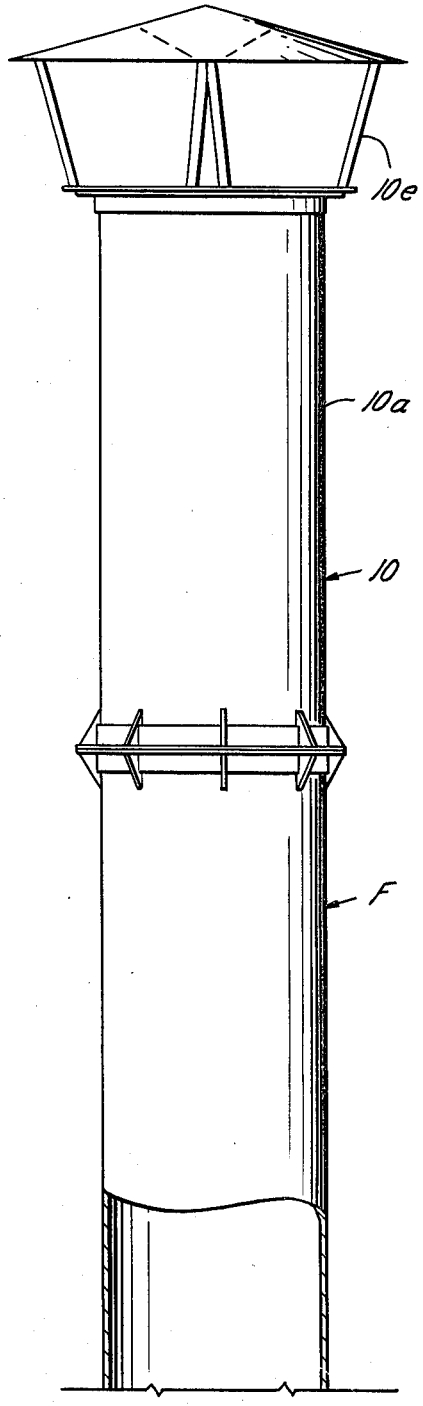
FIG. 1B shows an elevational, sectional view of the exhaust stack portion of the shaft-type furnace of FIG. 1A.
Figure 2:
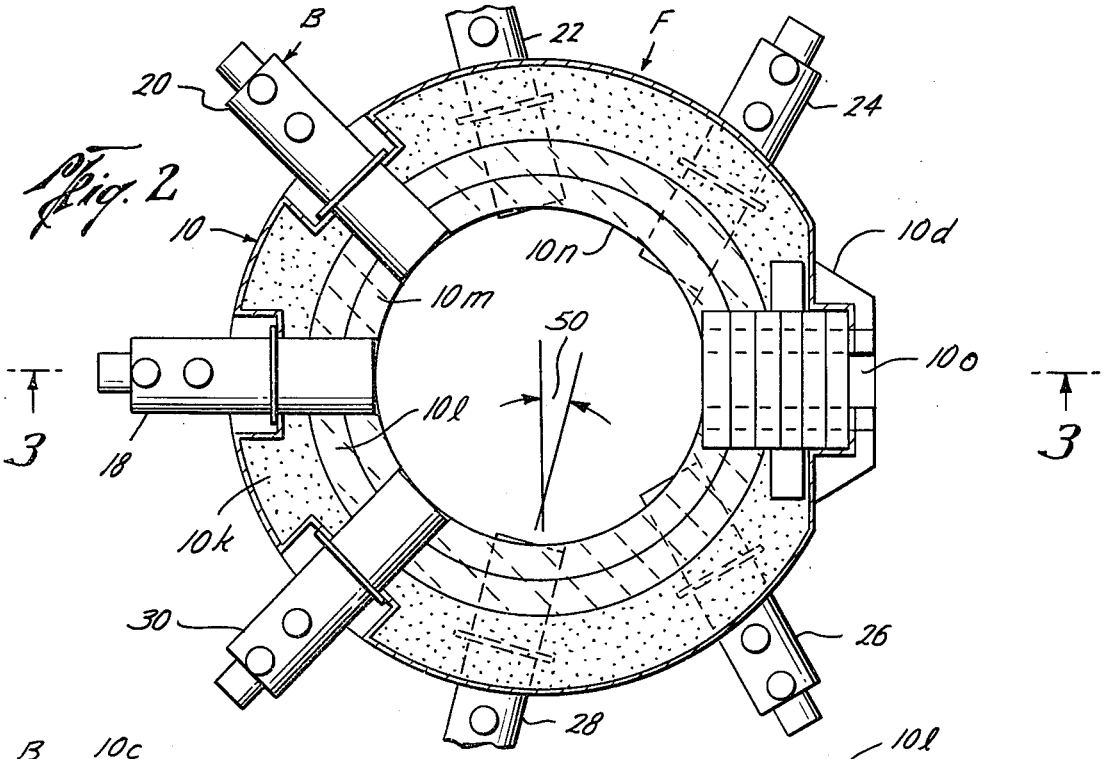
FIG. 2 is a plan view of the burner apparatus arrangement with the furnace as taken along the lines 2—2 of FIG. 3.

The burner apparatus B of the present invention is adapted to be mounted with the furnace F. The furnace F may be of any suitable type or design. For the purposes of explanation, and not by way of limitation, the furnace F may be of the shaft-type design such as the shaft-type furnace designated generally as 10 in FIGS. 1A and 1B. The shaft-type furnace 10 typically includes an exhaust stack 10*a*, a charging section 10*b*, a heating section 10*c* and a discharge portion 10*d*. A "doghouse"

or exhaust stack cover 10e is preferably positioned atop the exhaust stack 10a, with the exhaust stack 10a being mounted atop the charge section 10b of the shaft-type furnace 10.

The charge section 10b of the furnace F includes a charge opening 10f formed in the side of the charge section 10b. A charge material receiving ramp 10g is mounted with the internal portion of the shaft-type furnace 10 adjacent the charge section 10b with the charge material receiving ramp 10g extending up to the charge opening 10f. A suitable conveyor designated generally as 12 having a conveyor belt 12a and conveyor roller 12b is adapted to be positioned and mounted adjacent to the charge material receiving ramp 10g in order that a material charge as described more fully hereinbelow may be fed onto the material receiving ramp 10g in the direction of arrow 14 by the conveyor 12.

The heating section 10c of the shaft-type furnace 10 is mounted beneath the charge section 10b and receives the charge material from the charge material receiving ramp 10g. The heating section 10c generally includes an upper melter section 10h and a lower melter section 10i. The burner apparatus B of the present invention is preferably mounted with the lower melter section 10i of the furnace F (FIG. 3) and includes burners 16, 18, 20, 22, 24, 26, 28, 30, with such burner apparatus B being discussed more fully hereinbelow.

Figure 3:
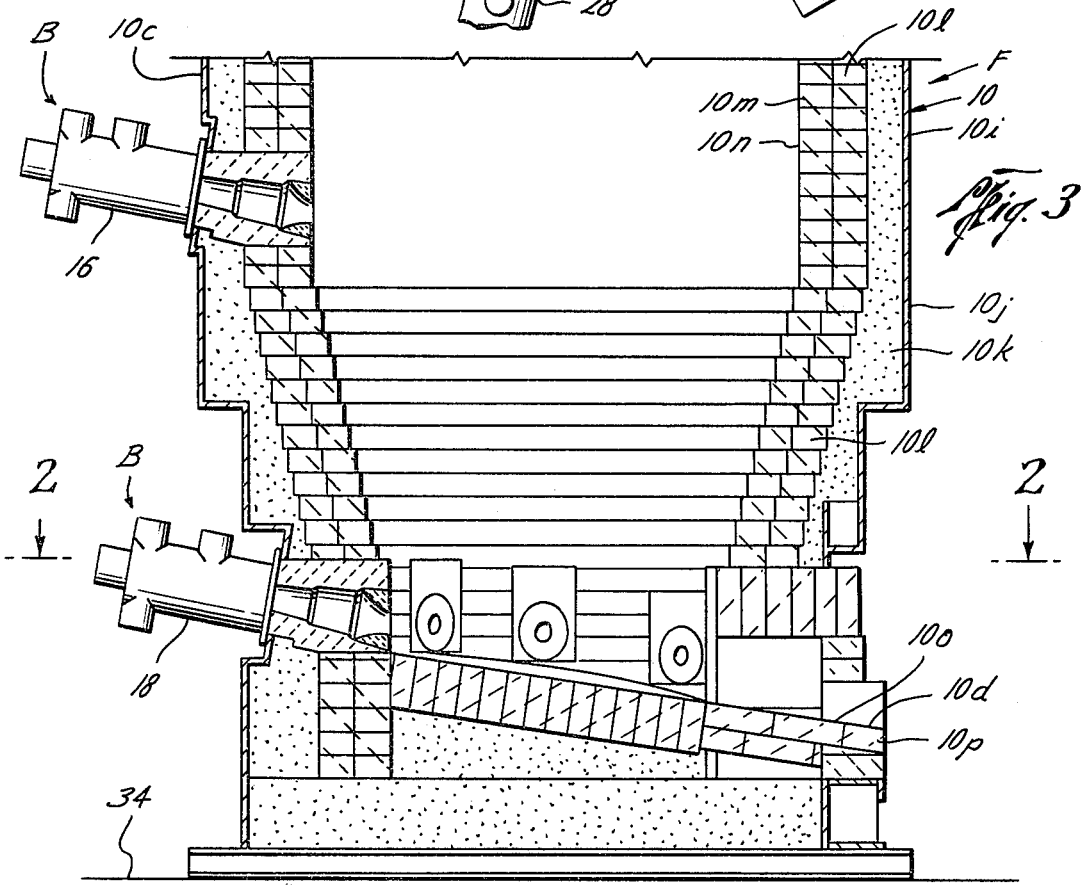
FIG. 3 is an enlarged, sectional, elevational view of the heating section and discharge portion of the shaft-type furnace, detailing the burner apparatus position therewith, as taken along the lines 3—3 of FIG. 2; and, FIG. 4 is an elevational, sectional view of a liquid fuel burner apparatus of the present invention.

As best seen in FIG. 3, the heating section 10c of the shaft-type furnace 10 is preferably of a multiple layer construction. The outer shell 10j of the furnace F is preferably formed of a suitable steel or other high-strength material capable of taking heavy stresses and strains typical to such furnaces F due to heavy charge material loading in addition to the high temperatures encountered. Preferably, a high alumina castable refractory concrete 10k is annularly disposed within the outer shell 10j between the outer shell 10j and fire brick 101. The fire brick 10l is disposed between the refractory concrete 10k and circle brick 10m. The circle brick 10m is preferably formed of silicon carbide, with the circle brick 10m forming the inner chamber 10n of the heating section 10c of the shaft-type furnace 10. The multiple layer construction of circle brick 10m, fire brick 10l, refractory concrete 10k and outer shell 10j provide an effective thermal barrier for the intense heating temperatures encountered in typical heating and melting operations in addition to being capable of supporting the mechanical loading thereof.

The discharge portion 10d of the furnace F is formed adjacent the lower end thereof. The discharge portion 10d includes preferably an incline discharge chute 10o which communicates with the inner chamber 10n of the lower melter section 10i of the heating section 10c of the shaft-type furnace 10. Preferably, the discharge chute 10o is formed of appropriate thermal bricks 10p, preferably of a silicon carbide material with the discharge chute 10o being inclined downwardly and outwardly into and in communication with a discharge trough 32 which receives molten charge material. The furnace F is adapted to be mounted on foundation 34 for the appropriate support thereof.

It will be appreciated that the furnace F, as disclosed hereinabove, is but one type of furnace that may be used in practicing the method and using the burner apparatus B of the present invention. Other types of furnaces may and can be used.

Figure 4:
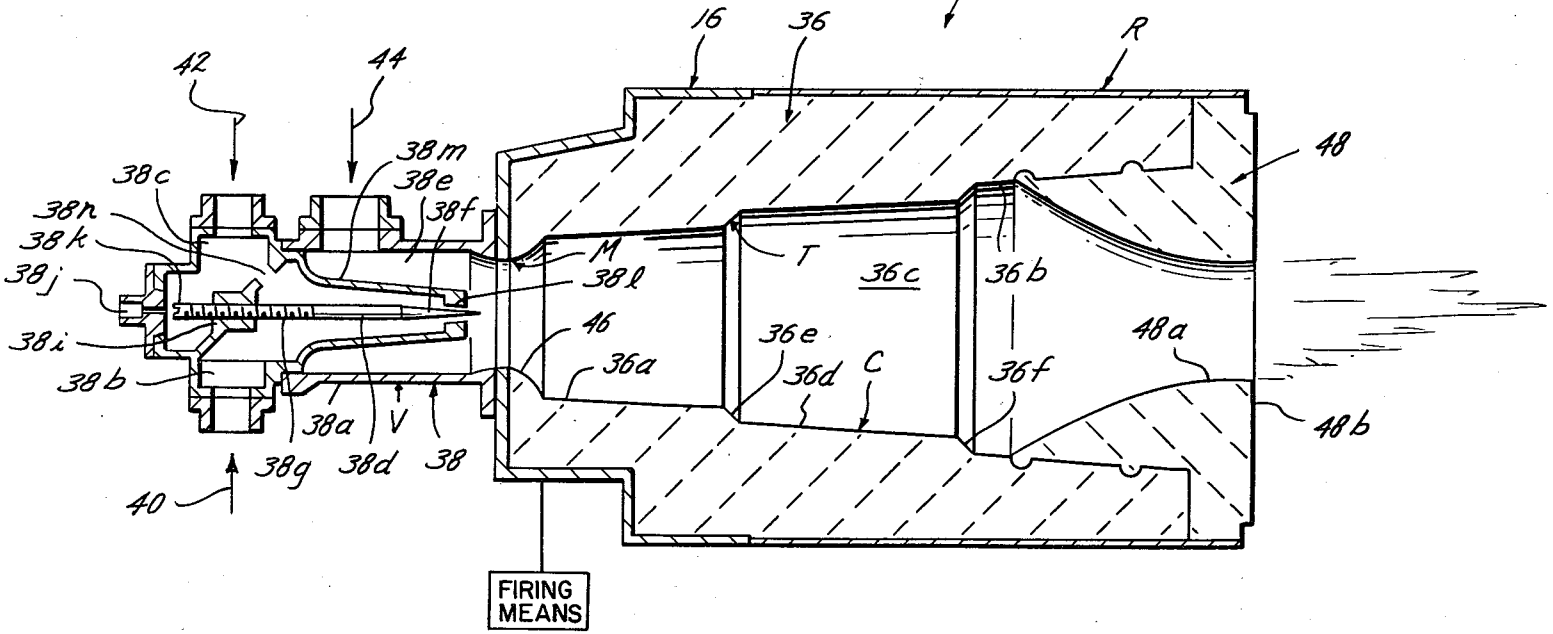

The burner apparatus B of the present invention is for combusting liquid fuel with atomizing air and combustion air for heating and melting a non-ferrous material charge within the furnace F without contaminating the charge with liquid fuel. As best seen in FIG. 4, the burner apparatus B includes a refractory block R, valve means V, mixing throat means M, and combustion chamber C having turbulence means T formed therewith, all as discussed more fully hereinbelow. For the purposes of explanation, the burner designated generally as 16 (FIGS. 1A, 3) will be discussed in full detail hereinbelow. Burners 18, 20, 22, 24, 26, 28 and 30 have identical structural components thereof, and accordingly do not require additional explanation.

The burner 16 of the burner apparatus B of the present invention, as shown in FIG. 4, includes a refractory block assembly R preferably formed of a high alumina refractory material. The refractory block R includes main block 36 that is adapted to be mounted with the furnace F adjacent to the lower melter section 10i of the shaft-type furnace 10. The block 36 preferably has a combustion Chamber C including inlet portion 36a, an exit portion 36b and a middle chamber 36c formed in block 36 between the inlet portion 36a and exit portion 36b. The combustion chamber 36c is formed having a chamber wall 36d that is of a generally truncated, conic configuration, with the chamber wall 36d increasing radially outwardly from the inlet portion 36a to the exit portion 36b.

Turbulence means T is preferably formed with the combustion chamber C of the burner apparatus B of the present invention for creating turbulence within the combustion chamber C. The turbulence means T includes at least one turbulence lip such as turbulence lip 36e or 36f that is formed with the chamber wall 36d. The turbulence lips 36e, 36f are formed extending radially outwardly from the chamber wall 36d and the inlet portion 36a for the reasons set forth and discussed more fully hereinbelow.

The burner apparatus B of the present invention further includes valve means V mounted with the refractory block R adjacent the inlet portion 36a. The valve means V includes a needle valve apparatus designated generally as 38. The needle valve apparatus 38 includes a valve housing 38a, a fuel chamber 38b, an atomizing air chamber 38c and a needle valve 38d. The valve housing 38a of the needle valve apparatus 38 is adapted to be mounted with the refractory block R adjacent the inlet portion 36a thereof. The valve housing 38a has the fuel chamber 38b, atomizing air chamber 38c, and a combustion air chamber 38e all formed therein.

The fuel chamber 38b of the valve means V is adapted to receive liquid fuel flowing in the direction of arrow 40 into the fuel chamber 38b. The atomizing air chamber 38c is adapted to receive atomizing air flowing in the direction of arrow 42 into atomizing air chamber 38c while the combustion air chamber 38e is adapted to receive combustion air flowing in the direction of arrow 44 into the combustion air chamber 38c. The chambers 38b, 38c, 38e are all in communication with appropriate supply lines (not shown) for providing the necessary fuel and/or air required for proper operation of the burner apparatus B of the present invention. As is known in the art, metering of the fuel and/or air in the supply lines may be accomplished by appropriate valving (not shown) mounted in the supply lines.

The needle valve apparatus 38 includes needle valve 38d disposed within the valve housing 38a. The needle valve 38*d* is formed having a needle portion 38*f* and a threaded shaft portion 38*g*. Internal webs locate the fuel chamber 38*b* and atomizing air chamber 38*c* within the valve housing 38*a* and also provides support for a suitable valve mounting block 38*i* for movably disposing the needle valve 38*d* within the fuel chamber 38*b*. The threaded shaft portion 38*g* of the needle valve 38*d* is adapted to threadedly engage compatible threads formed within the valve mounting block 38*i* to allow longitudinal movement of the needle valve 38*d* along the longitudinal axis thereof. Suitable adjustment of the needle valve 38*d* may be accomplished by engaging a slot 38*k* formed adjacent the end of the threaded shaft portion 38*g* by accessing the same through adjustment opening 38*j* formed in valve housing 38*a* of the needle valve apparatus 38.

A suitable passageway 38*n* allows communication of atomizing air in atomizing air chamber 38*c* and liquid fuel in fuel chamber 38*b* to communicate with one another in the fuel chamber 38*b*. When the needle valve 38*d* is in a full closed position, the needle portion 38*f* of the needle valve 38*d* engages needle seat 38*l* formed with nozzle 38*m* formed within the valve housing 38*a*. The nozzle 38*m* separates the combustion air chamber 38*e* and the fuel chamber 38*b* within the valve housing 38*a*. Appropriate rotation of the needle valve 38*d* allows regulation of the air/fuel ratio by regulating the mixture of liquid fuel and atomizing air with the combustion air within combustion air chamber 38*e* to be discharged therefrom into the combustion chamber C. Thus, the valve means V regulates the mixing of the liquid fuel and atomizing air with combustion air prior to the mixture entering the combustion chamber C.

The burner apparatus B of the present invention further includes mixing throat means M such as mixing venturi 46 formed between the inlet portion 36*a* of the refractory block R and the valve means V. The mixing venturi 46 receives the atomized liquid fuel from the valve means V and mixes the same with combustion air from the combustion air chamber 38*e*. The preferable elliptical cross sectional shape (in profile) of the mixing venturi 46 causes a throttling across the mixing venturi 46 for mixing the atomized liquid fuel with combustion air from the combustion air chamber 38*e*, being thereafter directed into the combustion chamber C. Substantially all mixing of the liquid fuel, atomizing air and combustion air occurs adjacent to the mixing venturi 46 of the mixing throat means M. The elliptical cross sectional shape (in profile) of the mixing venturi 46 helps to reduce the significant noise levels typically encountered in burners of the prior art.

The combustion chamber C of the burner apparatus B of the present invention receives the mixture of liquid fuel, atomizing air and combustion air for combusting substantially the entire mixture therein to provide thermal energy for heating and melting the non-ferrous material charge within the furnace F. Turbulence means T, as discussed hereinabove, includes turbulence lips 36*e*, 36*f* formed with the chamber wall 36*d* of the combustion chamber 36*c* ensures vaporization and substantially complete combustion of the mixture when within the combustion chamber C when firing.

The burner apparatus B of the present invention further includes an exit venturi 48 formed adjacent the exit portion 36*b* of the combustion chamber C. Preferably, the exit venturi 48 is of a diameter smaller than the adjacent exit portion 36*b* of the combustion chamber 36*c* and is of a reducing diameter wherein the throat 48*a* of the exit venturi 48 is at its smallest diameter adjacent end portion 48*b*. The end portion 48*b* of the exit venturi 48 is exposed directly to the inner chamber 10*n* of the heating section 10*c* of the shaft-type furnace 10. As a result, the exit venturi 48 has a cross sectional profile that is substantially elliptical in shape, which as with the mixing throat means M, helps to reduce the significant noise levels typically encountered with such burners, extend the life of the refractory block R, as well as helps to reduce back pressure in the combustion chamber C to promote vaporization of the liquid fuel.

The most significant problem that has arisen in prior art liquid fuel burners for firing a furnace for melting a non-ferrous material charge such as copper or aluminum, has been encountered in ensuring that no uncombusted air or fuel droplets contact the relatively cold surfaces of the non-ferrous material charge. Upon such a contact, the relatively cool surfaces of the charge material will preferentially remove oxygen from the gas stream mixture leaving the liquid fuel uncombusted resulting in contamination of the material charge with the fuel droplets, thus affecting the integrity and metallurgical quality of the melt. Accordingly, it becomes very desirable to ensure that no droplets of liquid fuel, in addition to any soot or carbon deposits, will contact any of the non-ferrous material charge.

In the operation of the burner apparatus B of the present invention, the refractory block R having the combustion chamber C therein confines most of the combustion processes within the combustion chamber C, rather than such taking place within the inner chamber 10*n* of the furnace 10. The use of such a combustion chamber C prevents carbon deposits and other products of combustion from forming on the non-ferrous material charge in the furnace F as typically happens when liquid fuels, such as fuel oil, comes in contact with the relatively cool surfaces of the material charge before combustion is complete. The valve means V and mixing throat means M of the present invention insure properly regulated and metered mixtures of liquid fuel and atomizing air with combustion air when received within the combustion chamber C. The turbulence means T within the combustion chamber C ensures vaporization and substantially complete combustion of the mixture within the combustion chamber C when firing to prevent contaminating the non-ferrous material charge in the furnace with non-vaporized liquid fuel in order to maintain metallurgical quality thereof. Both the mixing throat means M and the exit venturi 48 configurations help to effectuate an overall noise reduction typical with such a burner. Substantially all combustion occurs within the combustion chamber C eliminating the problem of liquid droplets actually contacting the non-ferrous material charge. As a consequence, various low grade qualities of liquid fuels such as various grades of fuel oils may be used for melting non-ferrous material, such as copper or aluminum, in low slag producing forms and, which when melted, is suitable for casting. Carefully controlled amounts of liquid fuel and atomizing air in addition to combustion air are fed into the burner apparatus B of the present invention where the fuel is atomized, vaporized and rapidly combusted within the combustion chamber C and then expelled at very high velocities into the inner chamber 10*n* of the furnace F where melting of the non-ferrous material charge takes place. Careful control of metallurgical qualities is effectuated by careful control of the combustion products. Control of the combustion products in turn is controlled by flow monitoring and/or gas analysis equipment (not shown) with each burner. Proper associated selections of fuel and fuel quality as combined with proper quantities of atomizing and combustion air result in combustion of the mixture external of the valve means V, not within the furnace F but rather within the combustion chamber C. The combustion chamber C enhances turbulent mixing of the liquid fuel therein and collects soot, if any, resulting from such combustion, thus preventing the contamination of the non-ferrous material charge within the furnace F.

As shown in FIG. 3, it is preferred that the burner apparatus B of the present invention be used as one of many for each furnace F. Further, it is preferred that the orientation of some of such burners as burners 22, 24, 26, 28 be such that their respective longitudinal axis do not pass through the longitudinal centerline of the furnace F, but rather make an angle with respect thereto, as angle 50 (FIG. 3) shows. This skewed orientation of some of the burners acts to increase turbulence within the furnace F to enhance heating of the charge material therein. The material charge is heated, melted and then discharged at the lower end of the furnace F adjacent the discharge portion 10*d* where such is directed into discharge chute 10*o* and outwardly from the furnace F into discharge trough 32 for appropriate casting thereafter.

In practicing the method of the present invention, the liquid fuel is received in the fuel chamber 38*b* while mixing with atomizing air received in the atomizing air chamber 38*c* for atomizing the liquid fuel prior to combustion. The needle valve 38*d* regulates the mixture of atomized liquid fuel with the combustion air for adjusting the air/fuel ratio. The atomized liquid fuel and combustion air combine adjacent the mixing throat means M formed between the valve means V and the refractory block R after the mixing. Thereafter, the mixture of liquid fuel, atomizing air and combustion air flows from the mixing throat means M into the combustion chamber C formed in the refractory block R where the mixture is turbulently mixed and enhanced by means of the turbulence means T formed with the chamber walls 36*d* of the combustion chamber C to ensure vaporization of the mixture for substantially complete combustion of the mixture within the combustion chamber C. The turbulent mixing further includes directing a portion of the mixture against at least one turbulence lip such as 36*e* and/or 36*f* formed with the chamber wall 36*d* of the combustion chamber C to increase the turbulent mixing action within the combustion chamber C. Thereafter, the vaporized mixture in the combustion chamber is fired, by any suitable firing means, for providing heat for melting the non-ferrous material charge in the furnace F while preventing contamination of the non-ferrous material charge in the furnace F with non-vaporized liquid fuel, to maintain the metallurgical quality of the non-ferrous material charge to be melted. Finally, the combusted mixture from the combustion chamber C is discharged through the exit venturi 48 which acts to lower noise, reduce back pressure in the combustion chamber C to further enhance vaporization of the liquid fuel and additionally helps extend the life of the refractory block R when compared to sharply restricted chambers.

Thus, the method for heating non-ferrous material charge with liquid fuel and the burner apparatus B for doing same of the present invention provides a new and improved method and apparatus for taking advantage of cost-saving low grade fuels while simultaneously providing uncontaminated non-ferrous melts of high metallurgical quality.

The foregoing disclosure and description of the invention are illustrative and explanatory thereof, and various charges in the size, shape and materials as well as in the details of the illustrated construction may be made without departing from the spirit of the invention.

What is claimed is:

1. A method for heating and melting a non-ferrous metal charge in a furnace utilizing liquid fuel, atomizing air and combustion air without contaminating the charge with the liquid fuel, comprising the steps of:

separately supplying liquid fuel, atomizing air and combustion air to a burner assembly mounted adjacent a refractory block formed in the wall of said furnace;

pre-mixing the liquid fuel and atomizing air within a valve housing means by flowing said atomizing air into and through said liquid fuel before coming into contact with said combustion air, then further pre-mixing said liquid fuel and atomizing air by flowing said mixture through a needle valve means for atomizing the liquid fuel prior to combustion;

combining the atomized liquid fuel with combustion air adjacent a mixing throat formed between the needle valve means and an inlet portion of the refractory block after said pre-mixing step;

flowing the mixture of liquid fuel, atomizing air and combustion air from the mixing throat past a first stepped turbulence means into a combustion chamber formed in the refractory block;

turbulently mixing the mixture of liquid fuel, atomizing air and combustion air to ensure vaporization of the mixture for substantially complete combustion of the mixture within the combustion chamber;

burning the vaporized mixture in the combustion chamber in order to provide heat for heating and melting the non-ferrous metal charge, while preventing contamination of the non-ferrous metal charge in the furnace with uncombusted fuel; and discharging the combusted mixture from the combustion chamber past a second stepped turbulence means through an exit venturi arranged within the refractory block, said exit venturi being of a diameter which reduces curvilinearly from an adjacent portion of the combustion chamber outwardly toward the throat of the refractory block;

whereby the metallurgical quality of the non-ferrous metal charge is maintained.

2. The method of claim 1 wherein:

said first and second stepped turbulence means are outwardly extending lips formed within said spaced apart longitudinally along the wall of the combustion chamber.

3. The method of claim 1, wherein said pre-mixing step includes the substeps of:

receiving liquid fuel in a fuel chamber formed in the valve housing means mounted on and in communication with the refractory block;

receiving atomizing air in an atomizing air chamber formed in the valve housing means and communicating with the fuel chamber; and regulating the mixture of liquid fuel and atomizing air with the combustion air in the needle valve means in the valve housing means which is in communication with the fuel chamber and the atomizing air chamber.

* * * * *